US007717760B2

(12) United States Patent
Ma

(10) Patent No.: US 7,717,760 B2
(45) Date of Patent: May 18, 2010

(54) ELECTRICAL CONNECTOR

(75) Inventor: Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/005,750

(22) Filed: Dec. 27, 2007

(65) Prior Publication Data

US 2008/0160806 A1 Jul. 3, 2008

(30) Foreign Application Priority Data

Dec. 27, 2006 (CN) ..... 2006 2 0169050

(51) Int. Cl.
*H01R 4/48* (2006.01)

(52) U.S. Cl. ..... 439/862; 439/135

(58) Field of Classification Search ..... 439/862, 439/66, 591, 701, 135, 136
See application file for complete search history.

(56) References Cited

U.S. PATENT DOCUMENTS

| | | | | |
|---|---|---|---|---|
| 6,699,055 | B2 * | 3/2004 | Peng et al. | 439/342 |
| 6,716,051 | B1 * | 4/2004 | Zeng | 439/342 |
| 7,361,023 | B2 * | 4/2008 | Wu | 439/66 |
| 2005/0215102 | A1 * | 9/2005 | Yu et al. | 439/342 |
| 2005/0260898 | A1 * | 11/2005 | Zhu et al. | 439/862 |

* cited by examiner

*Primary Examiner*—Edwin A. Leon
(74) *Attorney, Agent, or Firm*—Andrew C. Cheng; Wei Te Chung; Ming Chieh Chang

(57) ABSTRACT

Provided is an electrical connector for electrically connecting a plug assembly to a PCB. The electrical connector has a base mounted to the PCB, which has an upper surface and a lower surface opposite to the upper surface, a plurality of conductive contacts received in the base with partly extending above the upper surface, and a cover mounted on the upper surface of the base and having peripheral walls, a first and second surface. The base defines a plurality of incontinuous standoffs extending from the upper surface of the base.

5 Claims, 5 Drawing Sheets

12

ELECTRICAL CONNECTOR

BACKGROUND OF THE INVENTION

1. Field of the Invention

The present invention relates generally to an electrical connector, and more particularly relates to an electrical connector for electrically connecting a plug assembly to a PCB.

2. Background of the Invention

Zero Insertion Force (ZIF) electrical connectors are widely used for electrically connecting two electrical interfaces such as an electrical substrate, e.g. a PCB, and plug assembly, e.g. a central processing unit (CPU).

Typical conventional ZIP connectors are disclosed in Chinese Patent Nos. 2501204, 2588065 and U.S. Pat. Nos. 6,340,309, 6,431,900. Each of these connectors generally comprises a base connected to a PCB, a movable cover mounted on the base and a driving mechanism. The base includes a plurality of passageways and a plurality of conductive contacts received therein. The cover includes a plurality of through holes corresponding to the passageways in the base. The driving mechanism is used to drive the cover to move from an open position to a closed position. While the cover is at the open position, pins of the plug assembly are inserted into the through holes of the cover and the passageways of the base. At this time, the pins do not contact with any conductive contacts. While the cover is at the closed position, the plug assembly is electrically connected with the PCB by the pins contacting with the conductive contacts. However, in conventional electrical connector, the base is usually molded by an injected art and the conductive contacts are usually sealed in the passageways of the base, while the plug assembly is mated with the base. The heat exerted by the conductive contacts, when the connector is in using, is hardly to be distributed.

As electronic systems become more sophisticated, the systems require an increasing number of conductive contacts. Thus, as electronic systems become more advanced, the quantity of contacts with the electrical connector increase. The above-mentioned problem becomes more obvious and serious.

In view of the foregoing, a new and improved electrical connector is desired to solve above-mentioned problems.

SUMMARY OF THE INVENTION

Certain embodiments of the present invention provide an electrical connector for electrically connecting a plug assembly to a PCB. The electrical connector includes a base mounted to the PCB, which has an upper surface and a lower surface opposite to the upper surface, a plurality of conductive contacts received in the base with partly extending above the upper surface, and a cover mounted on the upper surface of the base and having peripheral walls, a first and second surface corresponding to the upper surface of the base. The base defines a plurality of incontinuous standoffs extending from the upper surface of the base.

While the cover is mounted on the upper surface of the base, certain distance is defined by the standoffs between the second surface of the cover and the upper surface of the base, and certain clearance is defined between the incontinuous standoff. As each conductive contacts extends with partly above the upper surface of the base, thus while the electrical connector is in use, heat exerted by the conductive contacts is distributed to the air via the clearance between the incontinuous standoffs.

DETAILED DESCRIPTION OF THE PREFERRED EMBODIMENT OF THE INVENTION

Hereinafter, the present invention will be described in detail with reference to the accompanying drawings.

Figure 1:
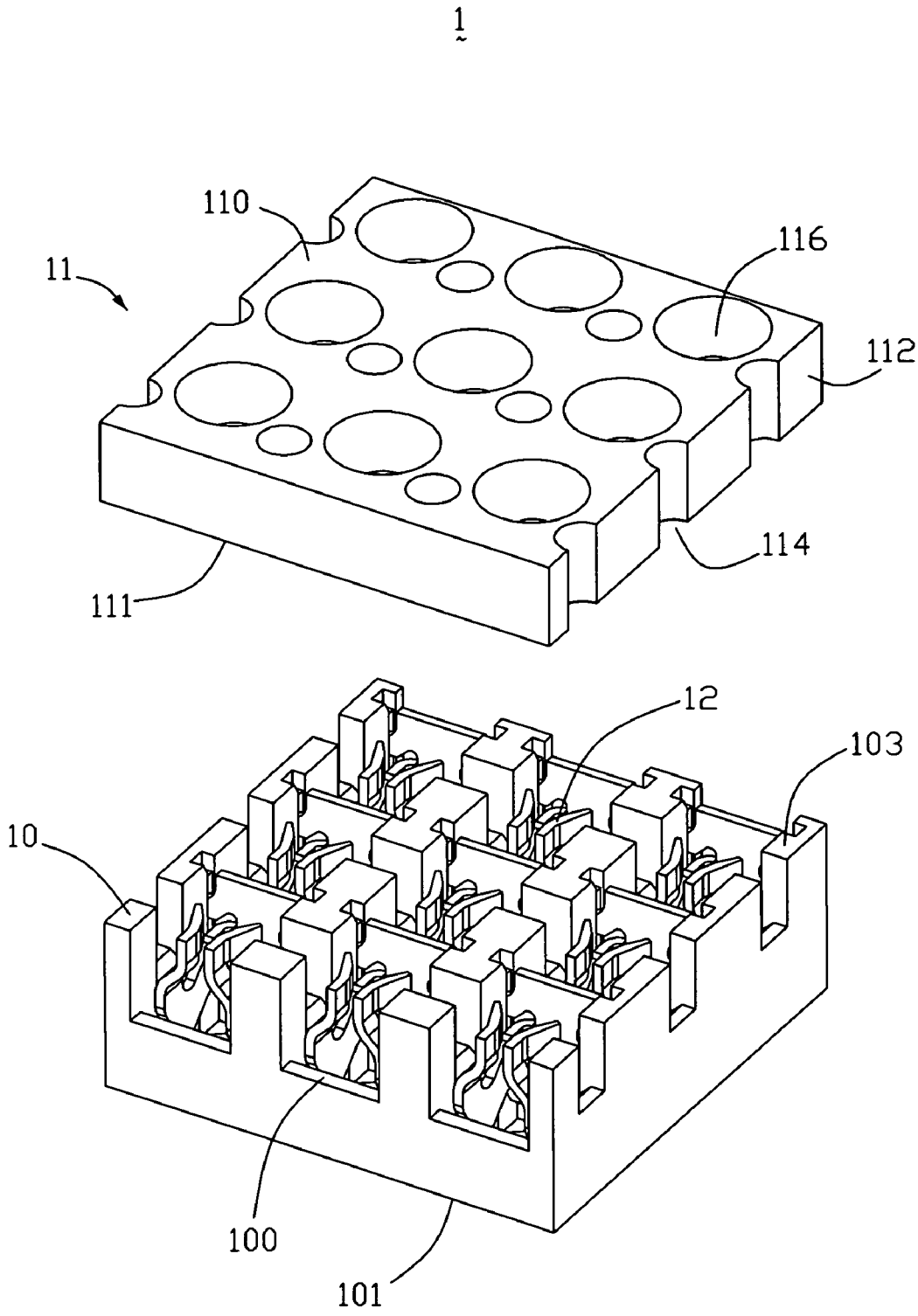
FIG. 1 illustrates an exploded view of an electrical connector of the first preferred embodiment formed in accordance with the present invention.
Figure 2:
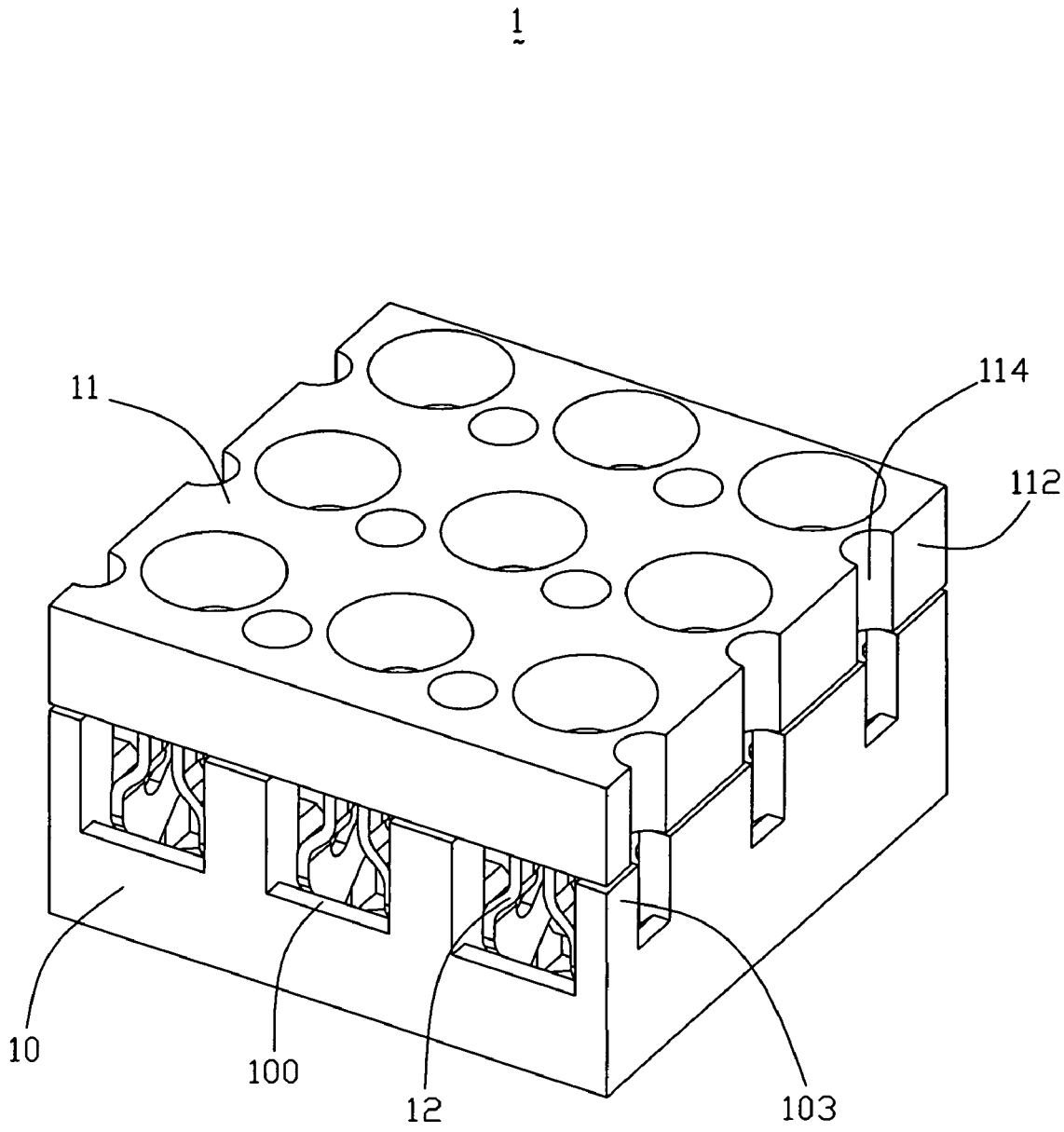
FIG. 2 illustrates an assembly view of an electrical connector mating with a plug assembly of the first embodiment in accordance with the present invention.

Referring to FIGS. 1-2, the electrical connector 1 accordance with a first preferred embodiment of the present invention is shown. The electrical connector 1 is used for establishing an electrical connection between a plug assembly (not shown), e.g. a central processing unit (CPU) and an electrical substrate, e.g. a PCB (not shown). The electrical connector 1 includes a base 10 connected to the PCB, a movable cover 11 mounted on the base 10 and a plurality of conductive contacts 12 received in the base 10.

The base 10 has an upper surface 100 and a lower surface 101 opposite to the upper surface 100. A plurality of passageways (not labeled) extends through both said upper and lower surface 100, 101 and is arranged in a matrix. The conductive contacts 12 receive in said passageways, respectively, with partly extending above the upper surface 100 of the base 10. A plurality of incontinuous standoffs 103 extends from the upper surface 100 of the base 10. The incontinuous standoff 103 have a common height.

The cover 11 is mounted on the upper surface 100 of the base 10 and has peripheral walls 112, a first surface 110 for carrying the plug assembly, and a second surface 111 opposite to the first surface 110 and corresponding to the upper surface 100 of the base 10. The peripheral walls 112 have a plurality of grooves 114 corresponding to the clearance between said standoffs 103. The grooves 114 each extends through both said first and second surface 110,111. A plurality of through 116 holes, which enables the pins of the plug assembly to be inserted into, extends through both said first and second surface 110, 111 and is corresponding to the passageways of the base 10.

As shown in FIG. 2, while the cover 11 is mounted on the upper surface 100 of the base 10, a certain distance is defined by the standoffs 103 between the second surface 111 of the cover 11 and the upper surface 10 of the base 10, and certain clearance is defined between the standoffs 103 because they are incontinuous. Because each conductive contacts extends with partly above the upper surface 100 of the base, thus while the electrical connector 1 is in use, heat exerted by the conductive contacts 12 is distributed to the air via said clearance between incontinuous the standoffs 103.

Figure 3:
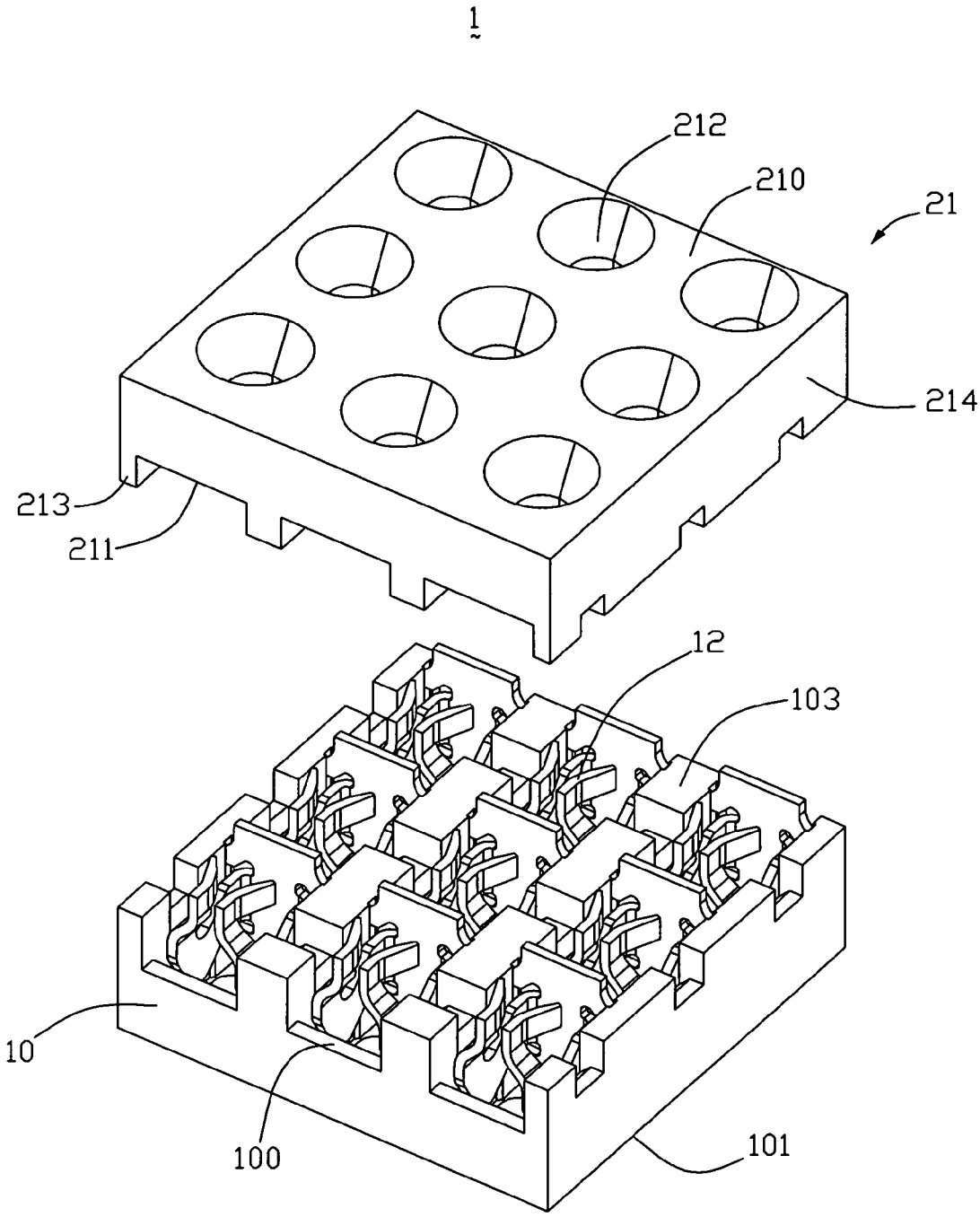
FIG. 3 is an exploded view of an electrical connector of the second embodiment formed in accordance with the present invention.
Figure 4:
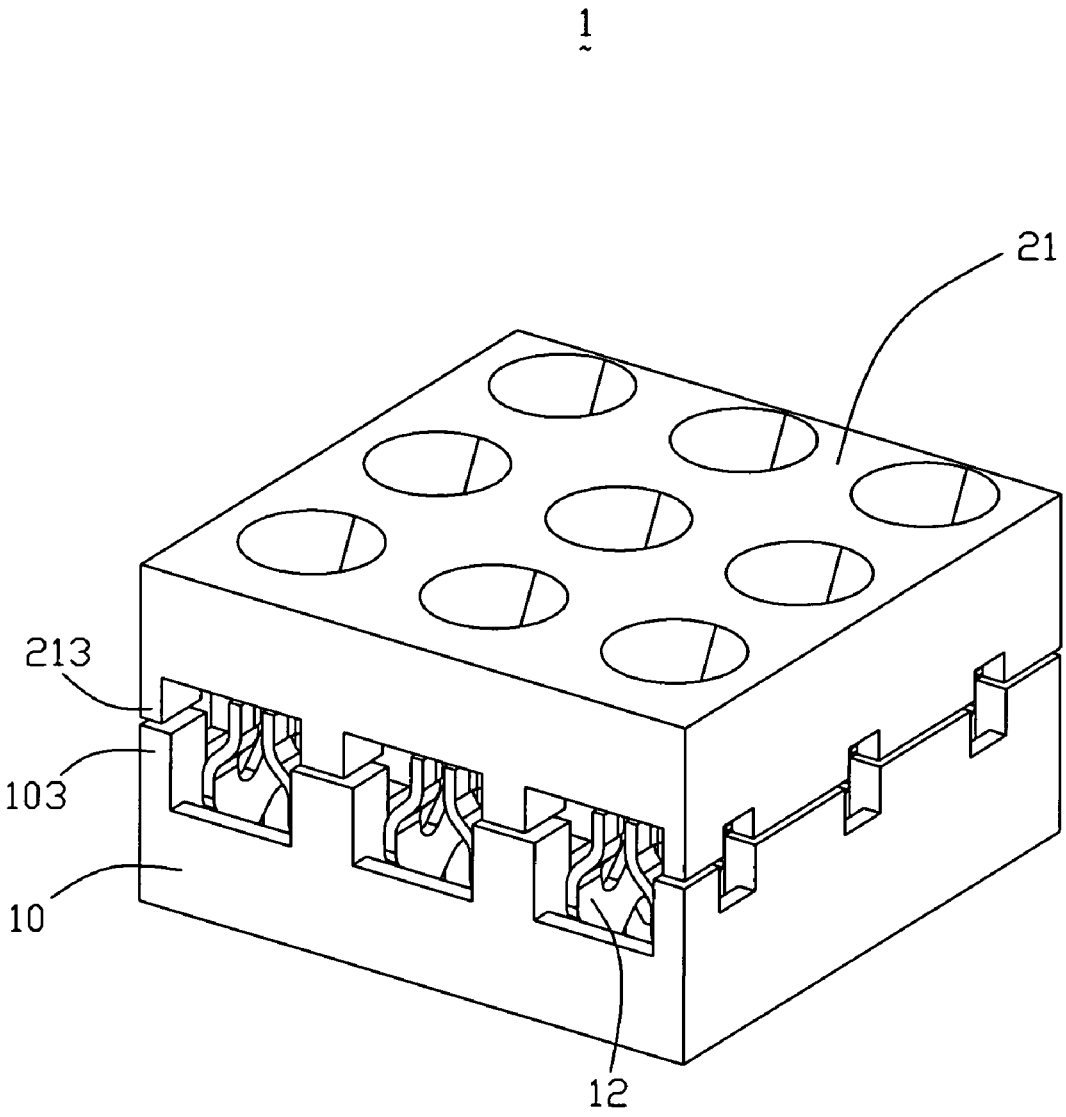
FIG. 4 is an assembly view of an electrical connector of the second embodiment formed in accordance with the present invention.

Referring to FIGS. 3-4, the electrical connector 1 in accordance with the second preferred embodiment of the present invention is shown and includes a base 10 connected to the PCB, a movable cover 21 mounted on the base 10 and a plurality of conductive contacts 12 received in the base 10.

The base 10 has an upper surface 100 and a lower surface 101 opposite to the upper surface 100. A plurality of passageways (not labeled) extends through both said upper and lower surface 100,101 and is arranged in a matrix. The conductive contacts 12 receive in said passageways, respectively, with partly extending above the upper surface 100 of the base 10. A plurality of incontinuous standoffs 103 extends from the upper surface 100 of the base 10. The incontinuous standoff 103 have a common height.

The cover 21 is mounted on the upper surface 100 of the base 10 and has peripheral walls 214, a first surface 210 for carrying the plug assembly, and a second surface 211 opposite to the first surface 210 and corresponding to the upper surface 100 of the base 10. A plurality of incontinuous projections 213 is corresponding to the standoffs 103 of the base 10 and extends from the second surface 211. The projections 213 may be arranged in a common height or/and in a same configuration. Also, the projections 213 of the cover 21 and the standoff 103 may have a common height. A plurality of through holes 212, which enables the pins of the plug assembly to be inserted into, extends through both said first and second surface 210, 211 and is corresponding to the passageways of the base 10.

As shown in FIG. 4, while the cover 21 is mounted on the upper surface 100 of the base 10, a certain distance is defined by the standoffs 103 and the projections 213 between the second surface 111 of the cover 11 and the upper surface 10 of the base 10. Certain clearance or cutout is defined between the incontinuous standoff 103 and certain clearance or through aperture is defined between the incontinuous projections 213. Because each conductive contacts 12 extends with partly above the upper surface 100 of the base 10, thus while the electrical connector 1 is in use, heat exerted by the conductive contacts 12 is distributed to the air via the clearance between the incontinuous standoffs 103 and the clearance between the incontinuous projections 213.

Figure 5:
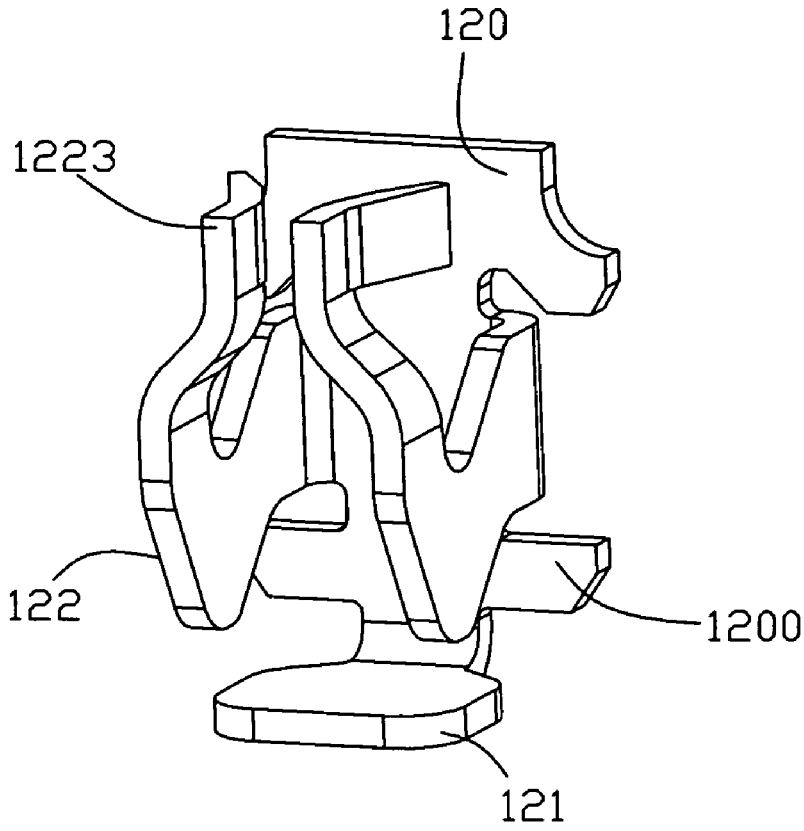
FIG. 5 is an isometric view of the conductive contact of the electrical connector in accordance with the present invention.

FIG. 5 illustrates a isometric view of a conductive contact 12 of the electrical connector 1 in accordance with the present invention. The conductive contact 12 is used in the electrical connector 1 in accordance with both the first the and second embodiment of the present invention. Each conductive contact 12 includes a body 120, a solder portion 121 extending from the body 120 and a pair of arms 122 extending from the body 120. The body 120 is generally of a platelike configuration, defining at least one retaining portion 1200, which is used for positioning the conductive contact 12 in the passageways. The solder portion 121 and the two arms 122 extend along a direction of and in same side of the body 120. The solder portion 121 extends from the bottom end of the body 120 and the two contacting arms extend from the two opposite sides of the body 120, respectively. Each arm 122 defines a contacting portion 1223, which is formed in end of the aim 122. A channel is defined by two contacting 1223, which is provided a space to allow the pin (not shown) of the plug assembly to be inserted into, while the plug assembly is mated with the electrical connector 1. While the pin of the plug assembly contacts with the conductive contact 12 of the electrical connector 1, an electrical connection between the electrical connector 1 and the plug assembly is established.

Furthermore, although the present invention has been described with the preferred embodiment referring to FIGS. 1-5, it is not to be construed as being limited thereto. Various alterations and modifications can be made to embodiment without in any way departing from the scope or spirit of the present invention as defined in appended claims.

The invention claimed is:

1. An electrical connector comprising:

an insulative base defining a plurality of up-to-down passageways arranged in a matrix manner and extending upwardly through an upper face of the housing;

each of said passageways essentially surrounded by circumferential partition walls;

a cutout formed in an upper portion of each of some of said partition walls so as to form a transverse passage for allowing air flow to pass;

a plurality of terminals disposed in the corresponding passageways, respectively under a condition that upper portions of each of the terminals extending adjacent to but not beyond the upper face; and an insulative cover slidably mounted upon the upper face;

wherein said cover defines a plurality of through holes in alignment with the corresponding passageways, respectively, for allowing pins of an electronic package to downwardly extend therethrough and into the corresponding passageways; and wherein said cover further includes a plurality of vertical through apertures horizontally offset from the corresponding passageway for heat dissipation.

2. The electrical connector as claimed in claim 1, wherein said through apertures are vertically aligned with the corresponding cutouts, respectively.

3. An electrical connector comprising:

an insulative base defining a plurality of up-to-down passageways arranged in a matrix manner and extending upwardly through an upper face of the housing;

each of said passageways essentially surrounded by circumferential partition walls;

a cutout formed in an upper portion of each of some of said partition walls so as to form a transverse passage for allowing air flow to pass;

a plurality of terminals disposed in the corresponding passageways, respectively under a condition that upper portions of each of the terminals extending adjacent to but not beyond the upper face; and an insulative cover slidably mounted upon the upper face;

wherein said cover defines a plurality of through holes in alignment with the corresponding passageways, respectively, for allowing pins of an electronic package to downwardly extend therethrough and into the corresponding passageways; and wherein said cover further includes a plurality of horizontal through apertures corresponding to and close to the corresponding cutouts, respectively.

4. The electrical connector as claimed in claim 3, wherein said through apertures are vertically aligned with the corresponding cutouts in a same vertical plane, respectively.

5. An electrical connector comprising:

an insulative base having a plurality of first and second sidewalls perpendicular to each other, the first and second sidewalls forming a plurality of passageways;

a cover slidably mounted upon the base and having a plurality of through holes corresponding to the passageways; and a plurality of terminals disposed in the corresponding passageways, each terminal comprising a body, a solder portion extending from the body, and a pair of arms extending from opposite sides of the body, each arm having a contacting portion extending to the body;

wherein the first sidewalls define a plurality of cutouts recessed from a top face thereof to a low end of the contact portion for communicating with the passageways at opposite sides of the first sidewalls; and wherein the cover defines a plurality of cutouts aligning with the cutouts of the base, respectively.

* * * * *